US011697148B1

(12) United States Patent
Spilker

(10) Patent No.: US 11,697,148 B1
(45) Date of Patent: Jul. 11, 2023

(54) HYDRAULIC FASTENER TOOL

(71) Applicant: Mark Spilker, Reno, NV (US)

(72) Inventor: Mark Spilker, Reno, NV (US)

( * ) Notice: Subject to any disclaimer, the term of this patent is extended or adjusted under 35 U.S.C. 154(b) by 0 days.

(21) Appl. No.: 17/676,180

(22) Filed: Feb. 20, 2022

Related U.S. Application Data

(63) Continuation-in-part of application No. 16/785,350, filed on Feb. 7, 2020, now Pat. No. 11,292,050.

(60) Provisional application No. 62/802,810, filed on Feb. 8, 2019.

(51) Int. Cl.

| | |
|---|---|
| ***B21J 15/10*** | (2006.01) |
| ***B21J 15/20*** | (2006.01) |
| ***B21J 15/32*** | (2006.01) |
| *B21J 15/02* | (2006.01) |
| *B21J 15/04* | (2006.01) |

(52) U.S. Cl.
CPC ..... *B21J 15/105* (2013.01); *B21J 15/20* (2013.01); *B21J 15/326* (2013.01); *B21J 15/022* (2013.01); *B21J 15/045* (2013.01)

(58) Field of Classification Search
CPC ..... B21J 15/022; B21J 15/043–15/045; B21J 15/20; B21J 15/105; B21J 15/30; B21J 15/326
See application file for complete search history.

(56) References Cited

U.S. PATENT DOCUMENTS

| | | | | |
|---|---|---|---|---|
| 2,527,307 | A | 10/1950 | Huck | |
| 2,531,048 | A | 11/1950 | Huck | |
| 3,107,806 | A | 10/1963 | Huck | |
| 3,116,848 | A * | 1/1964 | Hecke | B21J 15/045 72/391.6 |
| 3,215,024 | A | 11/1965 | Brilmyer | |
| 3,645,125 | A | 2/1972 | Summerlin | |
| 4,472,096 | A * | 9/1984 | Ruhl | F16B 19/05 411/361 |
| 4,979,279 | A * | 12/1990 | Garvey | B23P 11/00 72/391.2 |
| 5,060,359 | A | 10/1991 | Muir | |
| 5,090,852 | A * | 2/1992 | Dixon | F16B 19/05 411/361 |
| 5,146,773 | A | 9/1992 | Rosier | |
| 5,208,958 | A | 5/1993 | Wilcox | |
| 5,519,926 | A | 5/1996 | Rosier | |
| 5,598,619 | A | 2/1997 | Rosier | |
| 6,182,345 | B1 | 2/2001 | Travis | |
| 6,702,684 | B2 * | 3/2004 | Harbin | F16B 19/05 470/10 |
| 2006/0090318 | A1 | 5/2006 | Toosky | |
| 2008/0184545 | A1 | 8/2008 | Cobzaru | |

(Continued)

FOREIGN PATENT DOCUMENTS

| | | |
|---|---|---|
| WO | WO 0223056 A1 | 3/2002 |

*Primary Examiner* — Matthew P Travers
(74) *Attorney, Agent, or Firm* — Sharon Adams; Adams Law Office

(57) ABSTRACT

A tool for installing fasteners comprising a hydraulically powered tool with a tool body and handle, trigger for actuating the tool, piston, and a nose assembly comprising anvil assembly, puller, a spring inside a shock tube and collet assembly, and a free-floating ejector, wherein severed fastener pintails move backward through the spring to the rear of the tool. The anvil is in threaded connection to the anvil assembly and may be removed for cleaning and to access the free-floating ejector.

8 Claims, 6 Drawing Sheets

(56) References Cited

U.S. PATENT DOCUMENTS

| | | | |
|---|---|---|---|
| 2012/0030918 | A1 | 2/2012 | DeSalvo |
| 2013/0212849 | A1 | 8/2013 | Soller |
| 2014/0250649 | A1 | 9/2014 | Masugata |
| 2015/0273569 | A1 | 10/2015 | Lin |
| 2016/0107224 | A1 | 4/2016 | King |
| 2019/0013763 | A1 | 1/2019 | Woyciesjes |
| 2019/0247913 | A1 | 8/2019 | Lian |

* cited by examiner

HYDRAULIC FASTENER TOOL

CROSS REFERENCE TO RELATED APPLICATION

This application is a continuation-in-part of U.S. patent application Ser. No. 16/785,350 filed on Feb. 7, 2020, which is incorporated herein in its entirety.

STATEMENT REGARDING FEDERALLY SPONSORED RESEARCH

Not applicable.

NAMES OF THE PARTIES TO A JOINT RESEARCH AGREEMENT

Not applicable.

STATEMENT REGARDING PRIOR DISCLOSURES

Not applicable.

BACKGROUND OF THE INVENTION

At construction sites, and in other places, there is a need for a hydraulically-powered tool to fasten rivets, or fasteners. These tools are often used to fasten two or more work pieces together using rivets/fasteners with swage collars. The fasteners have a head and a stem and are inserted through the work pieces. Existing tools grasp the stem of a fastener, pull the stem into the tool body thereby "mushrooming" the swage collar of the fastener and securing the work pieces together. The stem of the fastener breaks and is propelled into the body of the tool.

Existing devices frequently jam, and often need cleaning or replacement of parts because flakes from the fasteners interfere with smooth operation of existing tools.

BRIEF SUMMARY OF THE INVENTION

The invention is a tool for quickly installing fasteners, and pushing the fastened workpiece with fastener out and away from the tool after use. This allows work to proceed more quickly and efficiently, saving time on the job because the operator does not need to remove the fastener or the fastener stem. The tool allows for easy and less expensive replacement of the anvil, and for easy cleaning of the tool, including internal components of the nose assembly of the tool.

The invention comprises a hydraulically powered tool with a tool body with a handle and a trigger for actuating the tool, a piston, and a nose assembly comprising an anvil assembly, a puller, a collet assembly, a spring, a shock tube, and a free-floating ejector.

Collet assembly 600 preferably comprises four segments, although any number of segments may be used. Each segment has an inside surface with a jaw section 623, a guide section 622, and a spring section 621. The outside circumference of the collet assembly is in moveable connection with an inside surface of the puller 500, which keeps the collet assembly in place. When confined by the inside circumference of puller 500, the curved inside surfaces of the segments of the collet assembly form a segmented circle or circumference. The curved inner surfaces of the jaw sections 623 form a segmented circumference that is capable of receiving and gripping a fastener stem. The curved inner surfaces of the guide sections 622 form a segmented circumference that is capable of guiding an ejected fastener stem backwards, and the curved inner surfaces of the spring sections 621 form a segmented circumference that is capable of receiving a spring 530.

When the collet is assembled, spring 530 fits within the circumference defined by a curved inner surface of spring sections 621 of the collet assembly.

Spring 530 is a guide spring, guiding a severed fastener stem backwards through the tool. Spring 530 is sized so that its internal circumference is slightly larger than the circumference of a fastener stem 21. The coils of spring 530 are sufficiently close together to allow a broken fastener stem to move back through spring 530 without catching on a spring coil.

Shock absorber tube 12 is positioned between the end of the collet assembly and piston 14. Shock tube 12 is preferably made of rubber but may be made of any material capable of absorbing shock.

The collet assembly is moveably disposed within a puller 500. The collet assembly is capable of moving within the puller. The uncompressed spring maintains the collet assembly in a forward position, toward the nose end. When a fastener stem is inserted into the collet jaws, the spring compresses and allows the collet assembly to move back slightly from the nose end toward the piston end. This allows the collet assembly segments to receive the fastener stem 21 into the collet assembly jaws, making it easier to insert the fastener stem into the tool.

The collet assembly and puller are disposed so that when actuated, the piston pulls the puller back, and the collet assembly is also pulled back.

The anvil assembly 400 is comprised of anvil 409, anvil adaptor 407, and anvil tube 406. In preferred embodiments anvil 409 comprises threads 411 for threaded connection with anvil adapter 407. The threaded connection allows for easy removal and replacement or cleaning of anvil 409. It is beneficial that anvil 409 is removable and may be easily removed and replaced, as this part of the tool tends to wear out quickly. In preferred embodiments, anvil 409 is in threaded connection with anvil adaptor 407, to allow for easy removal for cleaning the tool, and for replacing the anvil.

Free-floating ejector 800 is moveably constrained by anvil 409 and the nose ends of the collet assembly and puller. Free-floating ejector is not attached to any component, but moves within anvil 409 and the nose ends of the collet assembly and puller.

Removable anvil 409 may be removed and free-floating ejector may be accessed.

In operation, the nose end of the anvil rests on a workpiece, the collet jaws grip a fastener stem 21, the tool is activated, and high-pressure hydraulic fluid fills one chamber, causing the piston 14 to pull back, pulling the puller and collet assembly away from the head of the anvil. Once sufficient force is exerted the fastener stem 21 breaks and the force released by breaking the stem causes the stem to move backwards. The broken stem moves through the collet assembly via the guide section 622, through the internal diameter of spring 530, and through hollow passageway 16 inside the piston 14. In preferred embodiment, the severed stems are collected in container 25 where the severed fastener pintails can accumulate. At some point, a worker may open container 25 and dispose of the severed pintails.

The hydraulic liquid moves into another chamber and the puller 500 moves forward to its resting position. Ejector 800 is free-floating between anvil 409 and the nose end of puller 503 and nose end 605 of the collet assembly. As the puller and collet assembly move forward, they press ejector 800 forward, and ejector 800 pushes the fastened workpiece with fastener 20 out and away from the tool.

BRIEF DESCRIPTION OF THE SEVERAL VIEWS

FIG. 5 is also an end view of the nose end of the puller.

DETAILED DESCRIPTION OF THE INVENTION

Figure 1:
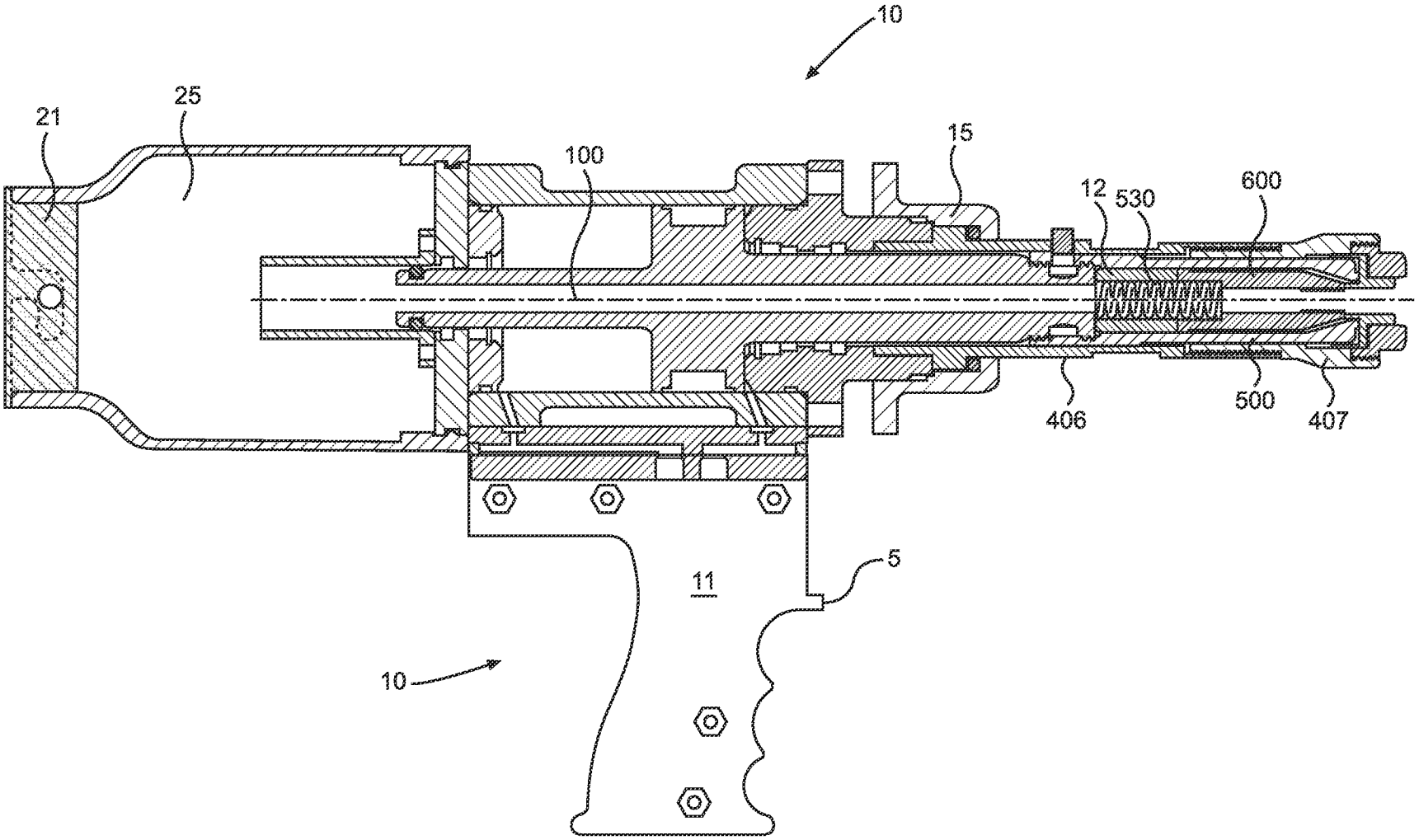
FIG. 1 is a cross section of the tool.
Figure 2:
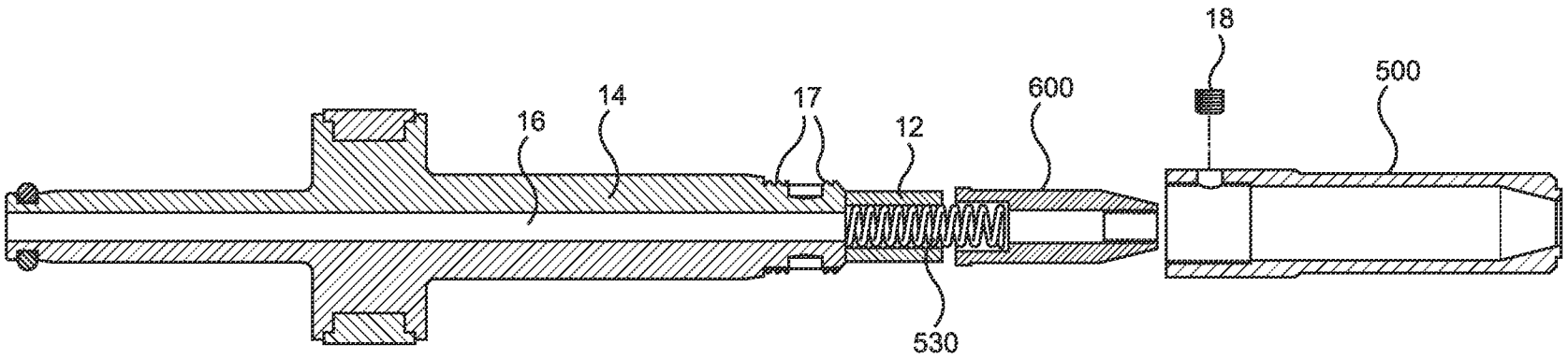
FIG. 2 is cross section of the piston, shock tube, collet assembly, and puller, also showing the spring.

The invention is a tool for quickly installing fasteners comprising a hydraulically powered tool 10 with a tool body and handle 11, trigger 5 for actuating the tool, piston 14, and a nose assembly comprising anvil assembly 400, puller 500, collet assembly 600, spring 530, shock tube 12, and free-floating ejector 800.

A retaining collar 15 connects the nose assembly to the body of the tool. The retaining collar has a forward surface with annulus that is sized to receive an outside cylindrical surface of anvil tube 406. The internal surface of retaining collar 15 further comprises threaded grooves for a threaded connection to removably connect nose assembly 400 with the tool body 11.

Figure 4C:
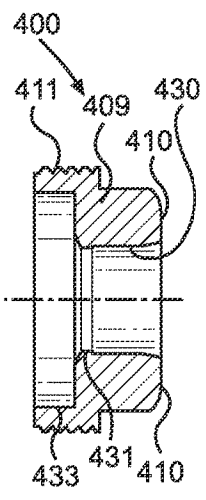
FIG. 4C is a cross-section of the anvil.
Figure 4B:
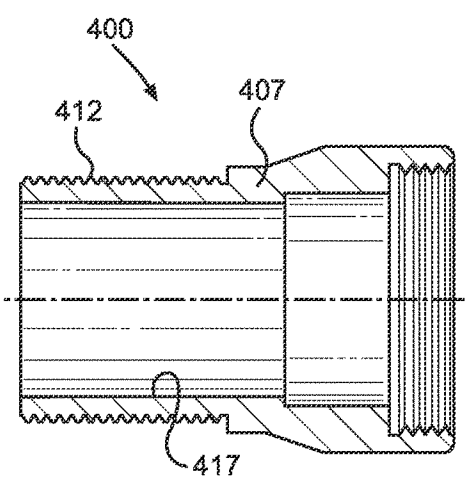
FIG. 4B is a cross-section of the anvil adaptor.
Figure 4A:
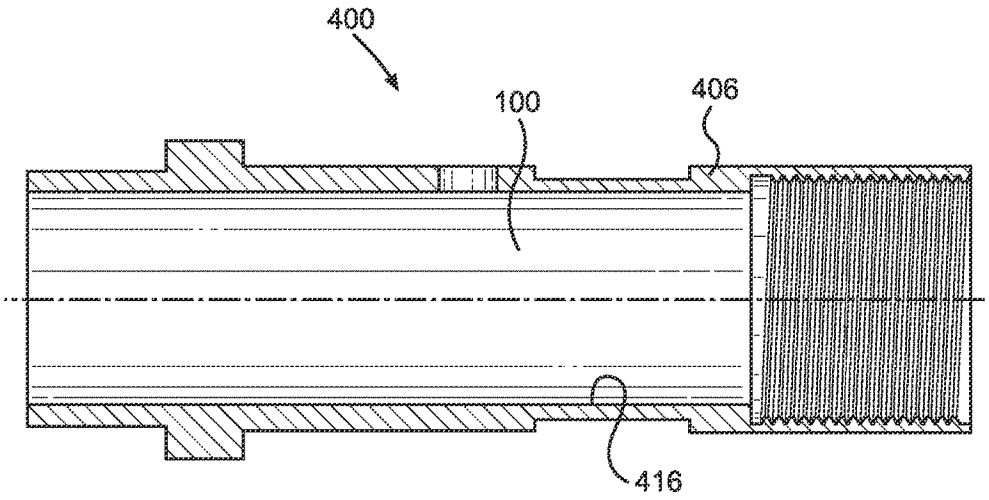
FIG. 4A is a cross-section of the anvil tube.

As shown in FIG. 4, anvil assembly 400 comprises anvil tube 406, anvil adapter 407, and anvil 409. Anvil 409 is removably connected with anvil adapter 407. In preferred embodiments anvil 409 has threads 411 for threaded connection with anvil adaptor 407, and anvil adaptor 407 has threads 412 for threaded connection with anvil tube 406. This allows the anvil assembly to be easily disassembled and cleaned, and also allows for easy removal and replacement of anvil 409. In other embodiments, anvil assembly may be connected using any means known in the art.

Both ends of anvil tube 406 and anvil adaptor 407 comprise annular openings so that anvil tube 406 and anvil adaptor 407 comprise a hollow cylinder with an internal diameter forming inside surfaces 416 and 417 around virtual center line 100.

In preferred embodiments, anvil adapter 407 is connected with anvil tube 406 to allow a step-down in the external diameter of the anvil assembly, as the nose end of anvil adapter 407 has a wider diameter than the piston end of anvil adapter 407. The piston end of anvil adapter 407 is sized for connection with anvil tube 406. An external circumference of anvil tube 406 is sized to fit within, and is configured to be in mating engagement with, retaining collar 15. The external circumference diameter of anvil tube 406 is sized to fit into the annulus in the forward surface of collar 15, thereby connecting the nose assembly to the tool body with a handle 11.

It is apparent that 406 and 407 may comprise a single piece. Having two pieces, having both 406 and 407, is preferred for tool function.

For tools used in industry, and elsewhere, the anvil wears out quickly. Removable anvil 409 makes it easier and less expensive to remove and replace the anvil.

Figure 7:
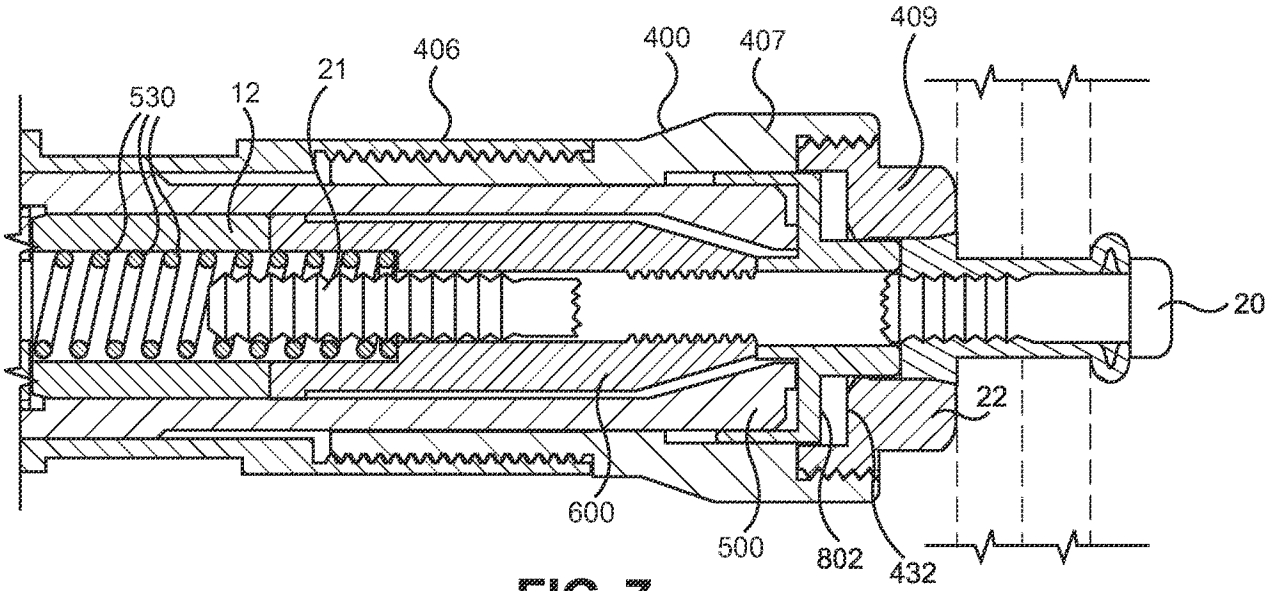
FIG. 7 is a cross-section of the anvil assembly, puller, collet assembly, spring, shock tube, ejector and fastener with a severed pintail.
Figure 8:
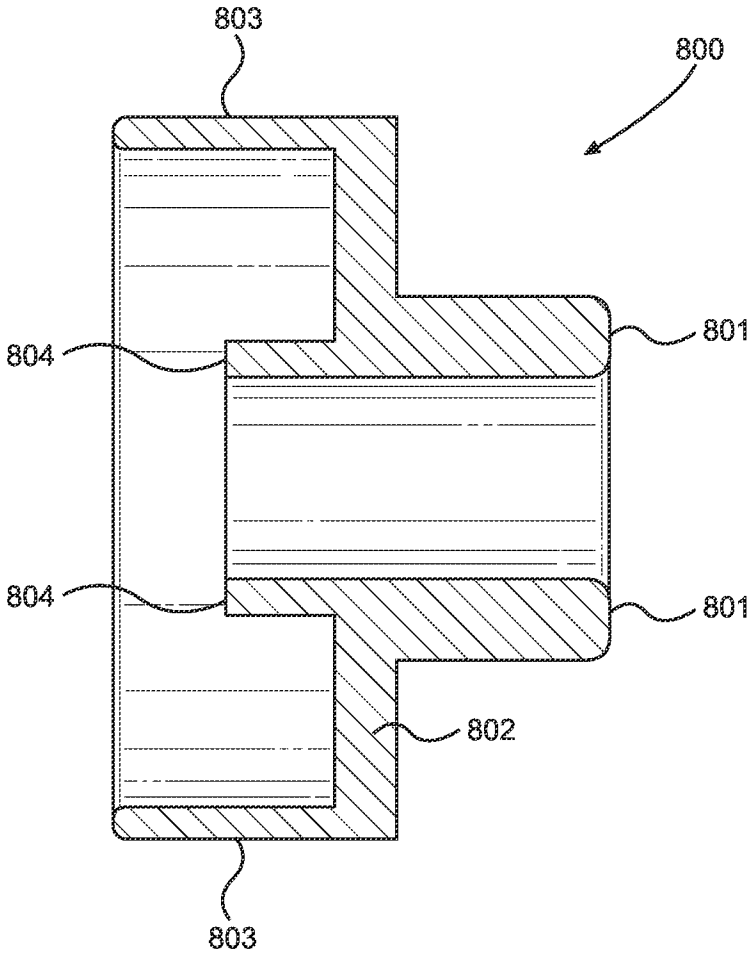
FIG. 8 is a cross-section of the free-floating ejector.

Anvil 409 further comprises features to receive and movably accommodate free-floating ejector 800, as shown in FIGS. 7 and 8. These comprise internal circumference 430 which is sized to receive pintail 21 and swage collar 22. Internal circumference 430 is also sized to receive an external circumference of the nose end 801 of free-floating ejector 800. Anvil 409 further comprises surface 432 and corresponds to surface 802 of free-floating ejector 800. Surface 432 and surface 802 are sized to seat against each other. Surface 802 moves forward in response to hydraulic pressure to seat against surface 432. Anvil 409 further comprises internal circumference 433. Internal circumference 433 is sized for moveable and snug engagement with an external column 803 of ejector 800.

In some embodiments anvil 409 may further comprise ridge 431 to assist with tool function in breaking the pintail.

In use, the nose end 410 of anvil 409 comes in contact with the work piece. The nose end of anvil 409 has an annular opening sized to receive ejector nose 801, and the pintail stem 21 of a fastener with swage collar 22, as shown in FIG. 7.

Figure 5:
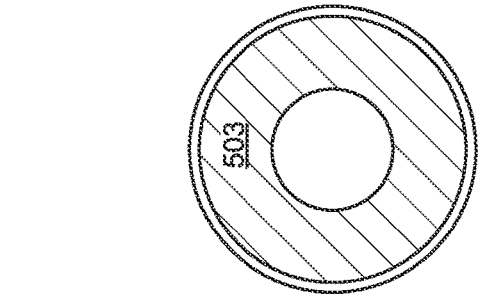
FIG. 5 is a cross-section of the puller.
Figure 5:
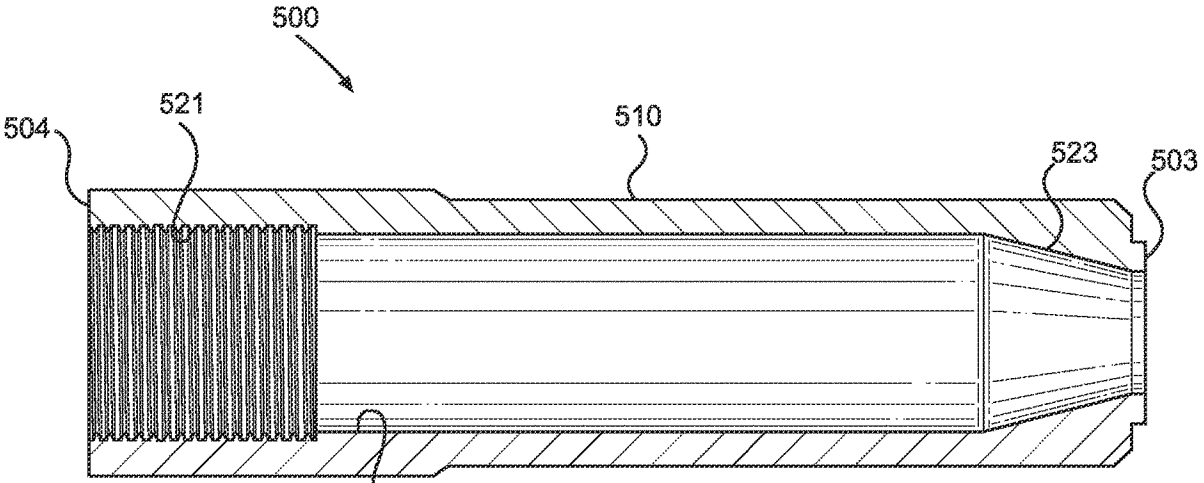

FIG. 5 shows a cross-section of puller 500, which comprises a hollow core with a nose end 503, a piston end 504, an outside surface 510, and an inside surface 520. Nose end 503 is shown in an end-view cross section in FIG. 5. Puller 500 fits inside anvil assembly 400, with mating and movable engagement with inside circumferences 416 and 417.

Inside surface 520 defines the core of puller 500. Inside surface 520 is generally a cylinder with frustoconical taper 523 toward nose end 503. In preferred embodiments, puller 500 comprises threads 521 for threaded connection and engagement with threads 17 on piston 14. The threaded connection removeably secures puller 500 to the piston 14. In other embodiments, other means for connection know in the art may be used to connect puller 500 with piston 14.

Nose end 503 of puller 500 rests against surface 802 of free-floating ejector 800, as shown in FIG. 7.

Frustoconical taper 523 and inside surface 520 comprise a circumference sized for moveable and snug engagement with an outside circumference of collet assembly 600.

In some embodiments, set screw 18 may be used to provide additional connection to piston 14, to prevent the puller from becoming disconnected from the piston.

Collet assembly 600 and shock tube 12 are sized to movably and snugly fit within the inside circumference of puller 500, as shown in FIG. 7. In particular, collet assembly 600 is sized for movable and snug fit within inside circumference 520 and taper 523, and shock tube 12 is sized for moveable and snug fit within inside circumference 520.

The collet assembly and puller are disposed so that when actuated, the piston pulls the puller back, and the collet assembly is also pulled back. However, as noted above, the collet assembly can move back within the puller, even if the puller does not move back to accommodate receiving the stem of a fastener.

The nose end of the collet assembly 600 and the nose end of the puller 500 are proximate to free-floating ejector 800. Nose end 605 of the collet assembly and the nose end 503 of the puller are not connected with free-floating ejector 800. Ejector 800 is proximate to, but not connected with, anvil 409. Free-floating ejector 800 is held in place by collet assembly 600, puller 500, and anvil 409, but is not attached to any of these.

Free-floating ejector 800 comprises nose 801, surface 802, external column 803, and internal column 804, as shown in FIG. 8. External column 803 is an annular column connected with an outside edge of surface 802. Ejector nose 801 is column-shaped, and on the opposite side of surface 802 from internal column 804. Surface 802 is a circular surface with a hole to create the continuous annular column between nose 801 and internal column 804. Nose 801 and internal column 804 form a continuous annular column that is sized to receive the pintail 21 of a fastener, but not the swage collar 22, as shown in FIG. 7.

Free-floating ejector is moveably constrained by the anvil, the nose end of the collet assembly, and the nose end of the puller. External column 803 has an external circumference that is sized to be moveably constrained within an internal circumference of anvil 409 and within an internal circumference of anvil adaptor 407. External column 803 may move forward and backward, sliding along the internal circumferences of anvil 409 and anvil adaptor 407. Surface 802 moves forward and backward relative to a flat surface in anvil 409. When hydraulic pressure moves the collet assembly and puller forward, thereby moving the ejector forward, surface 802 will press against a flat surface in anvil 409. However, surface 802 and anvil 409 are not connected.

Likewise, internal column 804 is proximate to nose end 605 of the collet assembly. Internal column 804 is moveably constrained by puller 500 and collet assembly 600. However, internal column 804 is not connected with the nose end 605 of the collet assembly. Thus, ejector 800 floats or moves freely between anvil 409, nose end 605, and nose end 503, without being connected with any of these.

The ejector may be removed by unthreading the anvil from the anvil adaptor.

In response to hydraulic pressure when the tool is activated, and after pintail 21 is broken, nose end 605 of the collet assembly presses free-floating ejector 800 forward, pressing nose 801 against swage collar 22, to push tool 10 and the workpiece away from each other after the fastener is fastened to the work piece.

Figure 6C:
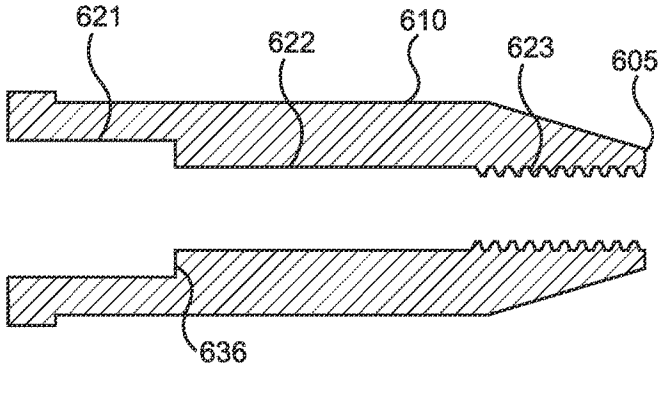
FIG. 6C is cross-section of the collet assembly.
Figure 6B:
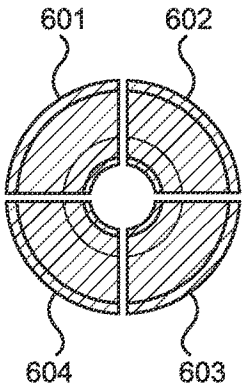
FIG. 6B is an end view of the nose end of the collet assembly.
Figure 6A:
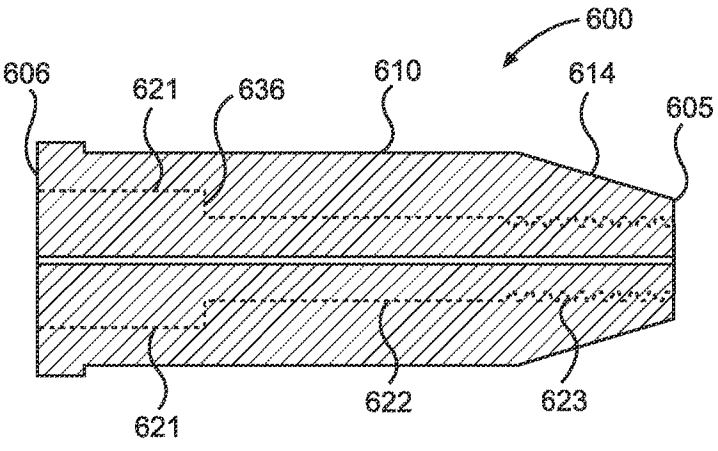
FIG. 6A is a see-through, exterior view of the collet assembly.

The collet assembly 600 is preferably formed by four separate segments, 601, 602, 603, and 604, shown in and end-view cross-section in FIG. 6B. It is apparent that the number of segments may be varied as needed or desired. The collet assembly is moveably disposed within an internal circumference of the anvil tube and anvil adaptor. The collet assembly comprises segments. Each segment comprises a jaw section with teeth, a guide section, and a spring section, with a rim between the guide section and the spring section.

The inside surface of each segment comprises three sections, a spring section 621, a guide section 622, and a jaw section 623. In the jaw sections 623, the inside circumference has a gripping surface comprised of grooves or teeth sized for gripping the fastener stem 21. In each segment, a straight rim 636 defines the boundary the guide tube section 622 and the spring section 621.

Jaw sections 623 form a circumference that is sized to receive and grip a fastener stem 21. Guide sections 622 form a circumference that is sized to receive the severed fastener stem and guide the severed fastener stem backwards. Spring sections 621 form a circumference that is sized to receive and constrain spring 530.

The outside segmented surfaces of collet 600 form a segmented column or circumference 610 that runs from the piston end 606 toward the nose end 605, whereupon the outside surface slopes 614 toward a nose end 605 of collet 600.

Slope 614 corresponds with the frustoconical taper 523 on the inside surface of the puller 500.

The nose edge 605 of each of the collet segment seats onto the ejector internal column 804 of free-floating ejector 800. When the tool is activated, the collet assembly moves backwards, pulling and breaking the fastener stem. Then, after the fastener stem is broken, the hydraulic forces of the tool move the collet assembly forward, pressing nose end 605 against ejector internal column 804, moving free-floating ejector forward thereby pushing the tool away from the now-fastened-workpiece.

As shown in FIG. 7, spring 530 comprises an external circumference sized to fit within an internal circumference of shock tube 12 and an internal circumference defined by spring sections 621. Spring 530 has an internal circumference that is slightly larger than the outside circumference of fastener stems 21.

The nose end of the spring 530 rests against the rim 636 between spring sections 621 and guide sections 622. Spring sections 621, and rims 636 are sized to seat and retain spring 530 so that the internal circumference of spring 530 is the same as the internal circumference of guide sections 622, forming a continuous hollow core. The circumference of this continuous hollow core is sized to allow a severed pintail 21 to move backwards along virtual center line 100 without deviating.

Spring 530 has sufficient spring force to move forward and backward to push collet assembly forward in the resting state, and to compress allowing the collet assembly to move back so that the collet jaws can open to receive a fastener stem at the start of use of the tool. The spring 530 has sufficient spring force, along with shock tube 12, to prevent the piston end of the collet segments from contacting the piston. The force released by breaking the stem causes the spring to compress and move backward Spring 530 comprises a length, wherein the length of the spring is disposed within an internal circumference of the shock tube and within the internal circumference of a spring section of the collect assembly. The length of spring 530 runs from rim 636 of the collet assembly to the piston 14. Spring 530 has an external circumference that runs along its length. The external circumference of spring 530 is sized to fit within, and be constrained by, an internal circumference of shock tube 12 and an internal circumference of spring sections 621 of the collet assembly, as shown in FIG. 7. Shock tube 12 and spring sections 621 allows the spring force to extend and retract the spring, while simultaneously constraining spring 530 from moving sideways. The allows a severed fastener stem 21 to move backwards through the collet assembly and shock tube. Spring 530 comprises a length of coils that run between a piston end of the collet assembly and the piston. The spring is disposed within an internal circumference of the shock tube and within the circumference of the spring sections of the collect assembly. The coils of spring 530 are spaced so that a severed fastener stem 21 will not catch on the coils.

Spring 530 may touch the piston 14, or may be close to touching the piston. In preferred embodiments, spring 530 is between 0 and 4 millimeters away from the piston head. It is apparent that the spring may be touching the piston head, or may be positioned slightly away from the piston head to achieve the desired effect, which is to dampen the forces.

Shock tube 12 is positioned between the end 606 of the collet assembly and piston 14. Shock tube 12 is preferably made of rubber but may be made of any material capable of absorbing shock. Shock tube 12 comprises a length. The length of shock tube 12 is equal to, or slightly less than, the distance between the end of the collet assembly and piston 14. In preferred embodiments, the length of shock tube 12 is slightly less than the distance between end 606 of the collet assembly and the piston 14 to allow collet assembly 600 to move backwards when the tool is placed over a fastener stem.

In use, the tool is placed around the stem 21 of a fastener 20. The collet assembly moves backward to expand and receive fastener stem. The fastener stem is inserted through and comes in contact with gripping jaws 623. This pushes the collet back slightly. This, along with four segments allows for easy insertion of the fastener stem. This creates less wear and tear on the gripping surface.

Figure 3:
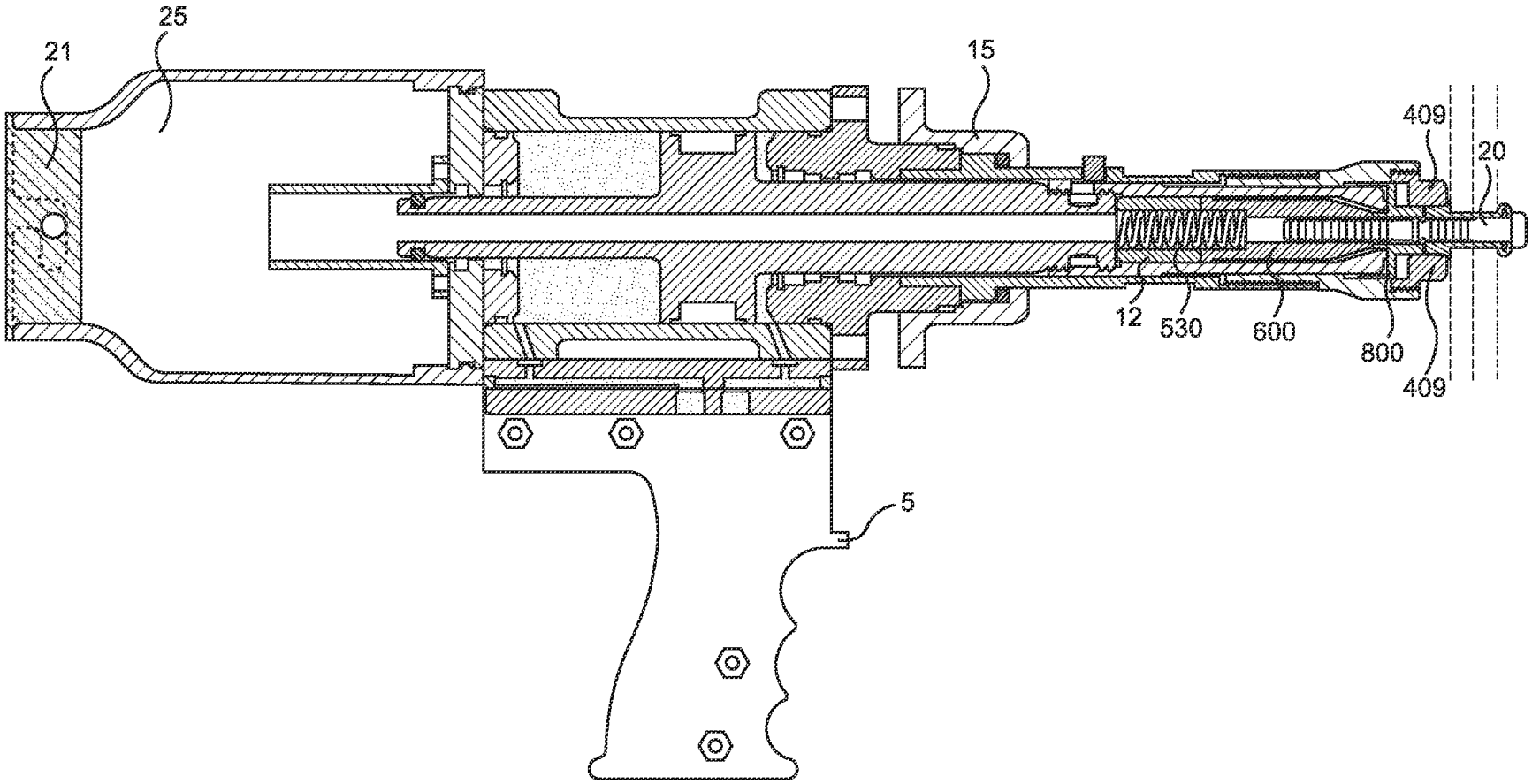
FIG. 3 is a cross section of the tool just after activation, showing the pintail gripped by the collet assembly jaws, but not yet broken.

After the collet assembly is pushed back and has gripped the fastener stem, the collet assembly moves forward to its resting position, gripping the fastener stem, as shown in FIG. 3.

Trigger 5 activates the tool by activating the hydraulic power system. In operation, the nose end of the anvil 409 rests on a workpiece, the collet jaws grip a fastener stem 21, the tool is activated, and high-pressure hydraulic fluid fills one chamber, causing the piston 14 to pull back, pulling the puller and collet assembly away from the workpiece. As explained above, piston 14 and puller 500 are connected, and thus puller 500 is also pulled back. This presses the taper 523 firmly against slope 614, compressing the jaw gripping surface 623 around the fastener stem 21, stretching and pulling back on fastener stem 21. Once sufficient force is exerted the fastener stem 21 breaks. Swage collar 22 begins to mushroom, or swag, and fastener stem 21 breaks, as shown in FIG. 7.

After the fastener stem 21 breaks, stem 21 is propelled back toward the piston end of the tool. Severed fastener stem 21 is guided by guide section 622 and spring 530 through the collet assembly to hollow channel 16 of piston 14, and in preferred embodiments may be feed into container 25. The fastener stems are collected in container 25 until container 25 is emptied, in preferred embodiments by opening twist lock end cap 21, although container 25 may be opened and emptied by any means known in the art. In other embodiments, there is no need to have container 25.

After stem 21 breaks, the hydraulic liquid moves into another chamber and the puller 500 moves forward to its resting position. As the puller moves forward toward the nose of the tool, the ejector 800 pushes the fastened workpiece with fastener 20 out and away from the tool. In particular, after pintail 21 is broken, nose end 605 of the collet assembly and nose end of puller 500 press free-floating ejector 800 forward, pressing nose 801 against swage collar 22, to push tool 10 and the workpiece away from each other after the fastener is fastened to the work piece.

It should be understood that the drawings and detailed description are not intended to limit implementations to the particular form disclosed but, on the contrary, the intention is to cover all modifications, equivalents and alternatives falling within the spirit and scope as defined by the appended claims. And, the drawing figures are not necessarily to scale. Certain features or components herein may be shown in somewhat schematic form and some details of conventional elements may not be shown or described in the interest of clarity and conciseness. As used throughout this application, the word "may" is used in a permissive sense (i.e., meaning having the potential to), rather than the mandatory sense (i.e., meaning must). Similarly, the words "include," "including," and "includes" mean including, but not limited to. The use of binaries—for example, first and second; right and left; forward and backward—is for identification purposes only.

What is claimed is:

1. A hydraulic fastener tool comprising:

a tool body with a handle and trigger;

a hydraulic power system activated by pulling the trigger;

a retaining collar connecting the tool body to a nose assembly comprising an anvil assembly, a puller, a collet assembly, a free-floating ejector, a spring, and a shock tube;

the anvil assembly comprising an anvil tube, an anvil adaptor, and a removeable anvil, wherein the anvil tube is connected with the retaining collar, the anvil adaptor is connected with the anvil tube, and a threaded connection removeably connects the anvil with the anvil adaptor;

a piston moveably disposed within the anvil assembly and connected with the puller, wherein the trigger activates the hydraulic power system and pulls the piston and puller back;

the collet assembly is moveably disposed within an internal circumference of the anvil tube and anvil adaptor, and the collet assembly comprises segments wherein each segment comprises a jaw section with teeth, a guide section, a spring section, and a rim between the guide section and the spring section, wherein the jaw sections form a circumference that is sized to receive and grip a fastener stem;

wherein the guide sections form a circumference that is sized to receive a severed fastener stem and guide the severed fastener stem backwards;

wherein the spring sections form a circumference that is sized to receive the spring;

and wherein a nose end of the segmented collet assembly rests on an internal column of the free-floating ejector;

the spring comprises a length of coils that run between a piston end of the collet assembly and the piston, wherein the spring is disposed within an internal circumference of the shock tube and within the circumference of the spring sections of the collet assembly, and wherein the spring coils are spaced so that a severed fastener stem moves backwards;

the free-floating ejector comprising a nose, a surface, an external annular column, and the internal column, wherein the nose and the internal column form a continuous annular column sized to receive the pintail of a fastener;

wherein the free-floating ejector is moveably constrained by the anvil, the nose end of the collet assembly, and a nose end of the puller, and wherein the ejector may be removed by unthreading the anvil from the anvil adaptor.

2. The tool of claim 1 wherein the anvil further comprises a ridge.

3. The tool of claim 1 wherein a threaded connection connects the anvil tube with the retaining collar.

4. The tool of claim 1 wherein a threaded connection connects the anvil adaptor with the anvil tube.

5. The tool of claim 1 wherein the piston is in threaded connection with the puller.

6. The tool of claim 1 wherein a set screw secures the puller to the piston.

7. The tool of claim 1 wherein the external annular column of the free-floating ejector is moveably constrained by the anvil and anvil adaptor, and the surface of the free-floating ejector is moveably constrained by a surface of the anvil and the collet assembly and puller.

8. The tool of claim 1 wherein the collet assembly comprises four segments.

* * * * *